US005315943A

United States Patent [19]

Sonoda

[11] Patent Number: 5,315,943

[45] Date of Patent: May 31, 1994

[54] SEWING MACHINE SAFETY DEVICE INCLUDING INTERCHANGEABLE WORK TABLES AND STITCHING

[75] Inventor: Takahisa Sonoda, Chofu, Japan

[73] Assignee: Juki Corporation, Chofu, Japan

[21] Appl. No.: 916,416

[22] Filed: Jul. 20, 1992

[51] Int. Cl.[5] ..... B05B 69/36

[52] U.S. Cl. ..... 112/162; 112/168; 112/260; 112/277

[58] Field of Search ..... 112/166, 168, 121.11, 112/200, 260, 261, 199, 258, 274, 277, 237, 271, 162; 318/40, 62, 101, 102, 103; 192/129 R, 129 A, 137

[56] References Cited

U.S. PATENT DOCUMENTS

| | | | |
|---|---|---|---|
| 2,418,356 | 4/1947 | Kleber | 112/271 |
| 3,025,812 | 3/1962 | Engel | 112/168 X |
| 3,889,615 | 6/1975 | Uozake et al. | 112/277 X |
| 3,926,133 | 12/1975 | Herron et al. | 112/168 |
| 3,985,087 | 10/1976 | Herr et al. | 112/237 |
| 4,178,862 | 12/1979 | Bianchi et al. | 112/121.11 |
| 4,233,919 | 11/1980 | Takahashi et al. | 112/277 |
| 4,248,167 | 2/1981 | Reinert | 112/277 X |
| 4,324,191 | 4/1982 | Brown | 112/277 |
| 4,498,405 | 2/1985 | Hanyu et al. | 112/168 |
| 4,690,080 | 9/1987 | Mikuni et al. | 112/162 |
| 4,815,404 | 3/1989 | Ellermann et al. | 112/121.11 |
| 5,078,067 | 1/1992 | Nakashima | 112/121.11 |
| 5,255,622 | 10/1993 | Baba et al. | 112/162 |

FOREIGN PATENT DOCUMENTS

| | | | |
|---|---|---|---|
| 62-27993 | 5/1987 | Japan . | |
| 63-107691 | 7/1988 | Japan . | |
| 63-275397 | 11/1988 | Japan | 112/277 |
| 4009179 | 1/1992 | Japan | 112/261 |
| 8903080 | 4/1989 | PCT Int'l Appl. | 112/277 |

*Primary Examiner*—Clifford D. Crowder
*Assistant Examiner*—Ismael Izaguirre
*Attorney, Agent, or Firm*—Morgan & Finnegan

[57] ABSTRACT

For conversion of stitch mode from one stitch shape to the other stitch shape without interference with one another, a safety device for a sewing machine, as a safeguard against malfunction of the machine when conversion is made, is equipped with a stitch forming signal generator means for associating a signal with a stitch mode, a mounting-demounting signal generator means for associating a signal with table displacement, and a circuit for rendering a motor inactive irrespective of operation of a controller for the motor.

6 Claims, 8 Drawing Sheets

SEWING MACHINE SAFETY DEVICE INCLUDING INTERCHANGEABLE WORK TABLES AND STITCHING

BACKGROUND OF THE INVENTION

1. Field of the Invention

This invention relates to a safety device for a sewing machine, and more particularly to a safety interlock mechanism which prevents the sewing machine from malfunctioning.

2. Description of the Related Art

FIG. 9 shows a currently available and well-known sewing machine M which is capable of converting the stitch mode from "one needle two thread stitches A" (chain stitches) as shown in FIG. 7 to "one needle three thread stitches B" (overlock stitches) as shown in FIG. 8, and vice versa. The sewing machine M as shown includes needle N, upper and lower loopers (not shown) incorporated in a looper cover 6, a control unit for controlling the drives of these members, and a motor as a drive source.

A controller 13 in the form of a foot pedal is manipulated to drive the sewing machine M through the motor and to adjust the drive speed thereof. As is well known, the lower looper for the sewing machine is adapted to perform its sewing operation below a work table 5, whereas the upper looper is adapted to perform a predetermined sewing operation above the work table 5. A change-over dial or knob 1 selects the stitch mode as either "one needle two thread stitches A" or "one needle thread stitches B."

For formation of the "one needle two thread stitches A", the change-over dial or knob 1 is set to select a mark A on the machine cover, indicative of the "one needle two thread stitches A" and at the same time a second work table 3 as seen from FIG. 9 is installed in the sewing machine M. This will allow the sewing machine M to drive the needle N and the lower looper, rendering them ready for formation of the "one needle two thread stitches A" whereas the upper looper is lowered and inactivated in a position where the upper looper does not abut against the second work table 3.

When the "one needle three thread stitches B" mode is desired, the change-over dial or knob 1 is set to select the other mark B on the machine cover, indicative of the "one needle three thread stitches B," and at the same time a chip guard cover 4 (FIG. 1) is attached to the sewing machine M. This will allow the sewing machine M to drive the needle N and the upper and lower loopers, rendering them ready for formation of the "one needle three thread stitches B".

The aforementioned conventional sewing machine has disadvantages in that the upper looper is liable to collide with the second work table 3 if the change-over knob 1 is set to select the mark B indicative of the "one needle three thread stitches" with the second work table 3 attached to the sewing machine M as illustrated in FIG. 9. This may be dangerous to the operator since the second work table 3, the upper looper as well as the sewing machine M can break down and scatter fragments, thereby injuring the operator.

SUMMARY OF THE INVENTION

It is, therefore, an object of the present invention to provide a safety device for a sewing machine, which is configured to overcome the aforementioned disadvantages inherent in the prior art.

Another object of the invention is to provide a safety device for sewing machines, which includes a stitch forming signal generator means adapted to transmit a "one needle three thread stitch" signal, and which is designed to stop the sewing machine regardless of whether the controller is actuated, so that the sewing machine is prevented from malfunctioning when the second work table is installed and the "one needle three thread stitch" signal is transmitted.

A further object of the invention is to provide a safety device for sewing machines, which facilitates conversion of stitches from one mode to another mode by appropriately preventing the motor from being driven, particularly if the sewing machine is inadvertently operated when the change-over dial or knob is switched.

These and other objects of the invention are accomplished by providing a safety device with a stitch forming signal generator means for transmitting either a "one needle three thread stitch" signal or a "one needle two thread stitch" signal in association with the means for converting the stitches from one to the other mode, and a mounting-demounting signal generator means for transmitting a mounting signal or a demounting signal in association with mounting or demounting of a second work table whereby a motor is prevented from driving, regardless of whether the controller is operated, when the "one needle three thread signal" is transmitted by the stitch forming signal transmitter means, and the mounting signal is transmitted by the mounting and demounting signal generator means.

BRIEF DESCRIPTION OF THE DRAWINGS

The invention will be described in greater detail below by way of reference to the accompanying drawings, wherein.

DESCRIPTION OF THE PREFERRED EMBODIMENTS

Figure 1:
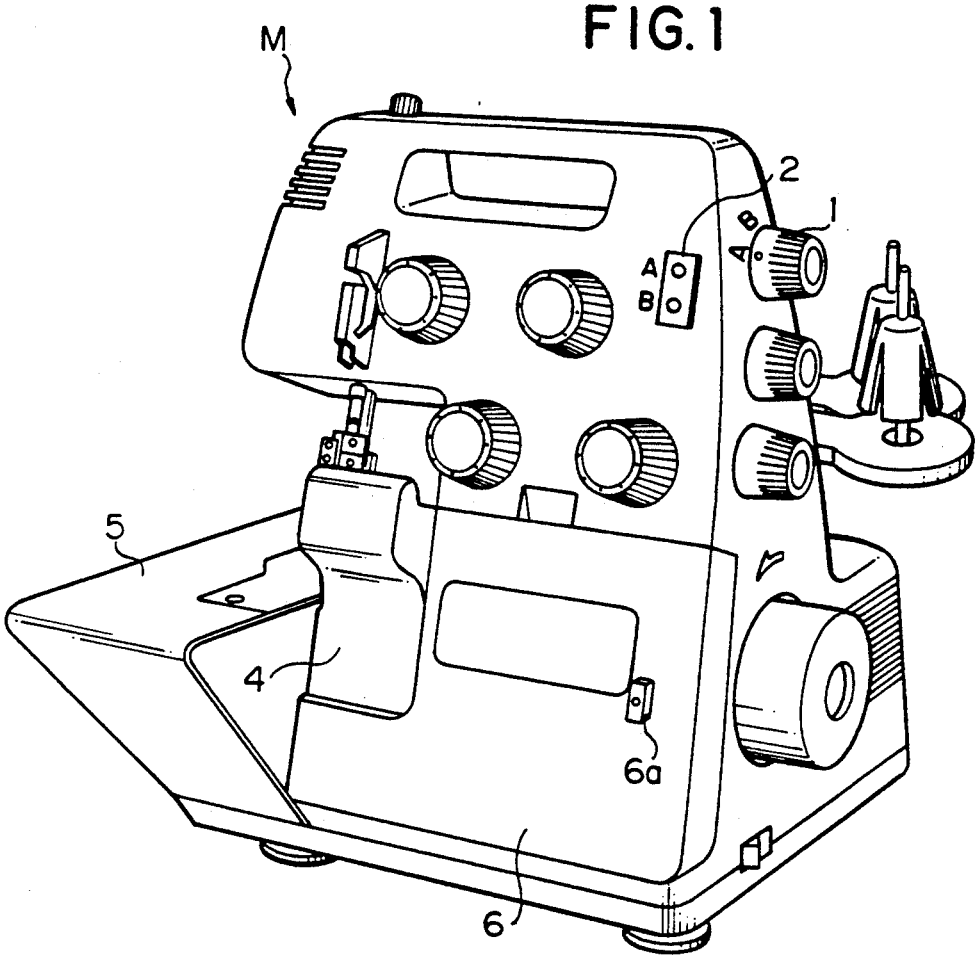
FIG. 1 is a perspective view generally showing a safety device for a sewing machine, embodying the present invention.

The invention will be described hereinafter in conjunction with the accompanying drawings, particularly, FIGS. 1 through 6, wherein like reference characters designate like or corresponding parts throughout the views.

Referring to FIG. 1, a stitch forming signal generator means 2 transmits either a one needle three thread stitch signal or a one needle two thread stitch signal to a control unit of a sewing machine M is association with a mechanism 1 for change-over operation.

Figure 2:
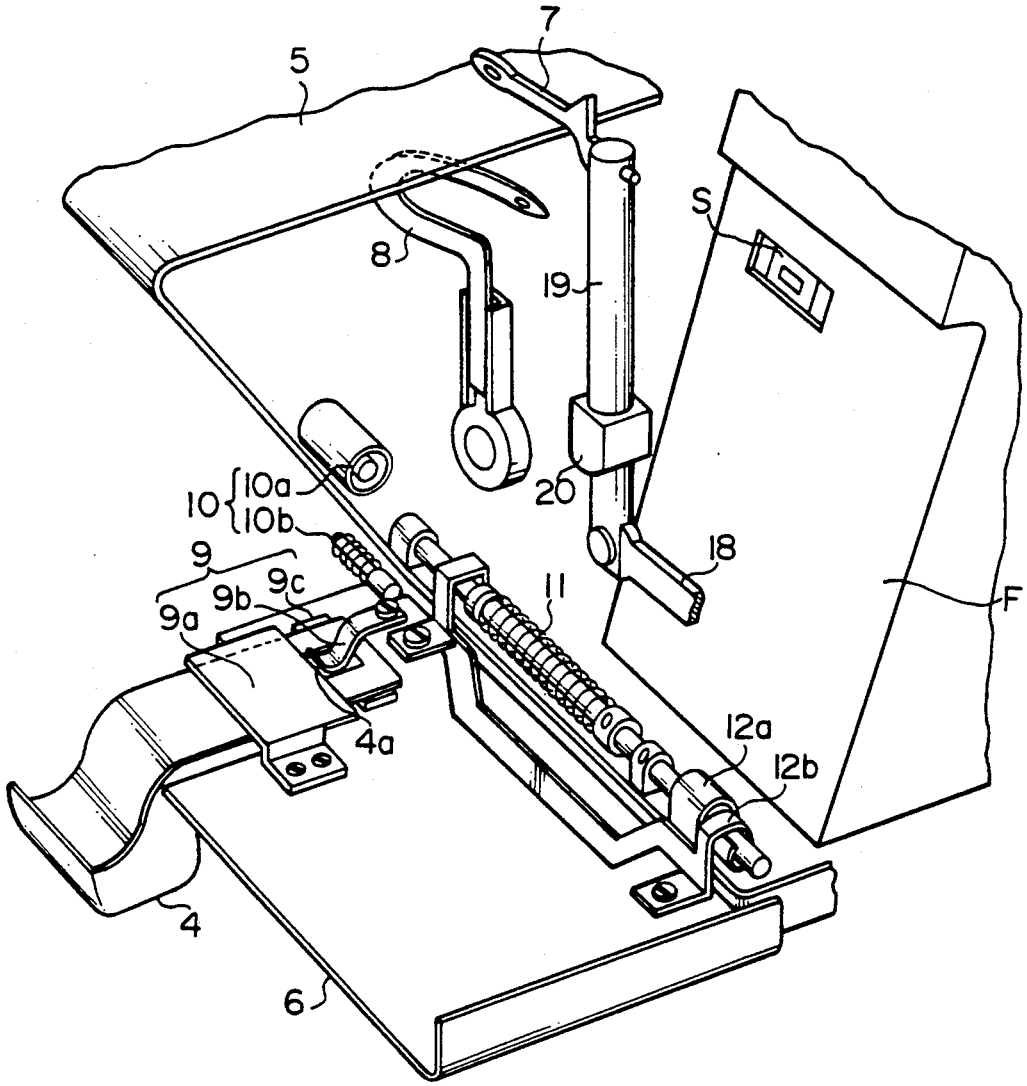
FIG. 2 is a perspective view of the sewing machine partially broken away for the purpose of illustration of the interior thereof.
Figure 9:
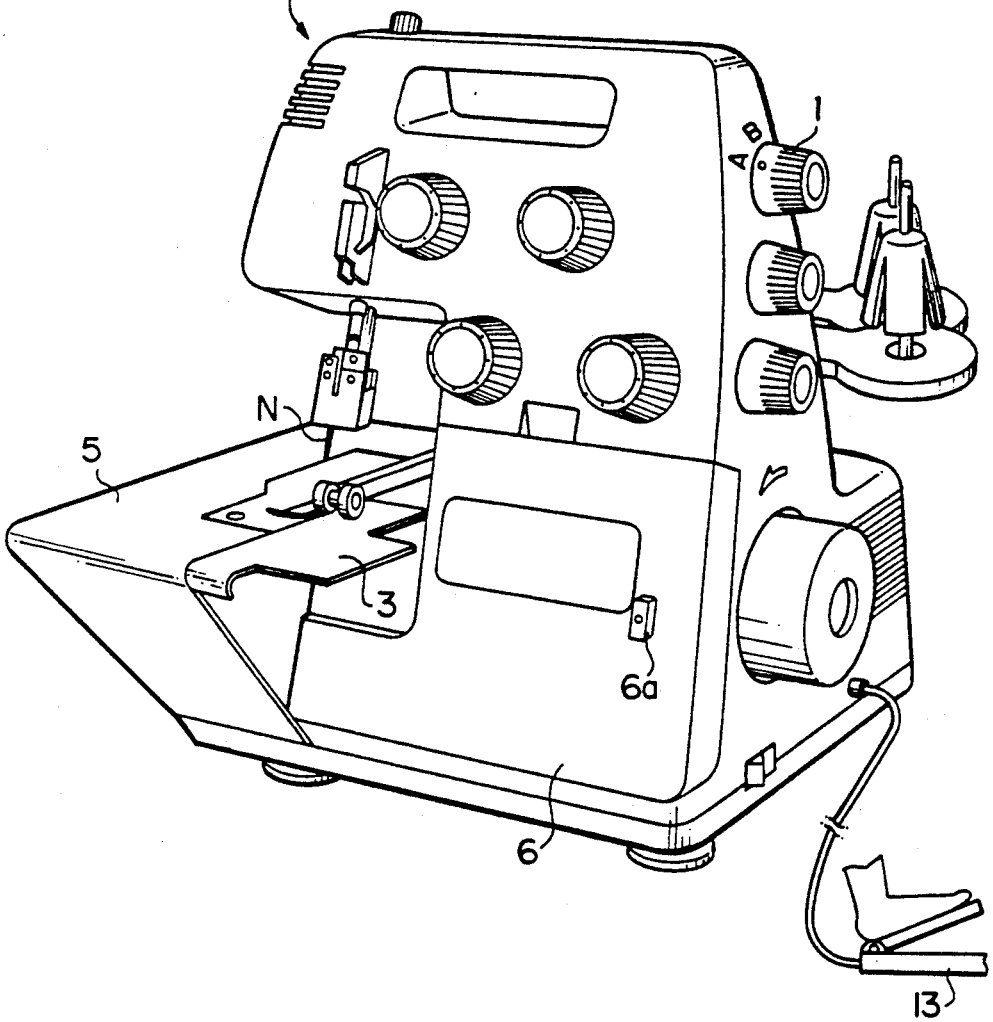
FIG. 9 is a conventional sewing machine which is provided with a second work table installed therein.

A looper cover is shown perspectively in FIG. 2 as being opened and is provided with a switching tongue 6*a* (FIG. 9) which is laterally moved to contact a spring 11, thereby disengaging a latch member 12*a* formed on a work table 5 from another latch member 12*b* disposed on the looper cover 6 to bring the latter into an open condition.

Upper and lower loopers 7 and 8, respectively, are connected to a drive means (not shown) for the sewing machine and adapted to actuate a predetermined drive. A looper cover switch 10 comprises a switch member 10*a* mounted below the work table 5, and a switch actuator 10*b* disposed on the looper cover 6. As a precaution, the switch member 10*a* is disengaged from the switch actuator 10*b* when the looper cover 6 is brought into the open condition so that the switch member 10*b* is off, thereby preventing the sewing machine M from driving.

The looper cover 6 is attached to a frame F which is provided with a mounting-demounting signal transmitter means S. When in contact with anything, this transmitter means S is turned to ON to send a mounting signal to the control unit, but when not in contact with anything it is turned to OFF to transmit a demounting signal to the control unit. A holder means 9 is disposed on the looper cover 6 for supporting or holding a chip guard cover 4 or the second work table 5 and comprises a clamp plate 9*a*, an end guide 9*c*, and a leaf spring 9*b*.

As is best shown in FIG. 2, the chip guard cover 4 is held in position by the end guide 9*c* to prevent the former from laterally slipping and is held down by the clamp plate 9*a* to engage the leaf spring 9*b* in a through hole 4*a*; that is, the chip guard cover 4 is supported in position by a hold-down means. When the chip guard cover is installed, the mounting-demounting signal generator means S transmits the demounting signal to the control unit since nothing contacts the generator means S, even when the looper cover 6 is closed.

Figure 3:
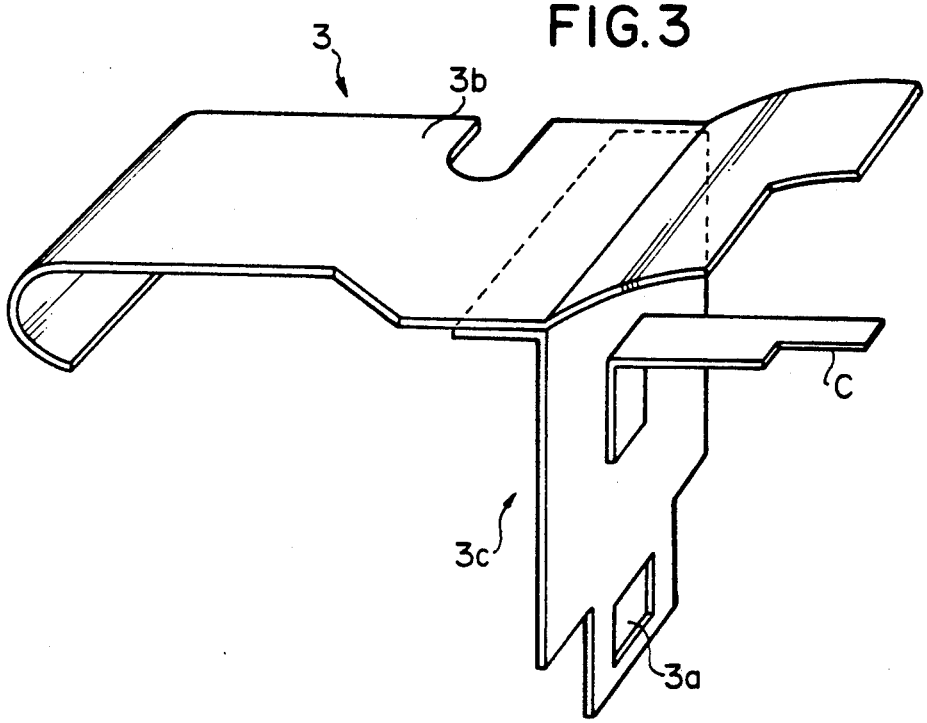
FIG. 3 is a perspective view of a second work table and showing the details of the structure.

The second work table 3, as perspectively shown in FIG. 3, comprises a workpiece supporting plate 3*b*, and a retainer 3*c* to be engaged with the holder means 9 by the leaf spring 9*c* which is fitted into a through hole 3*a* therein. The retainer 3*c* includes an engageable segment C horizontally extended therefrom. When the second work table 3 as held by the holder means 9 is brought into a sewing condition by closing the looper cover 6, the mounting-demounting signal generator means S is turned to ON to apply the mounting signal to the control means by engaging the engageable segment C with the mounting-demounting signal generator or transmitter means S.

Figure 10:
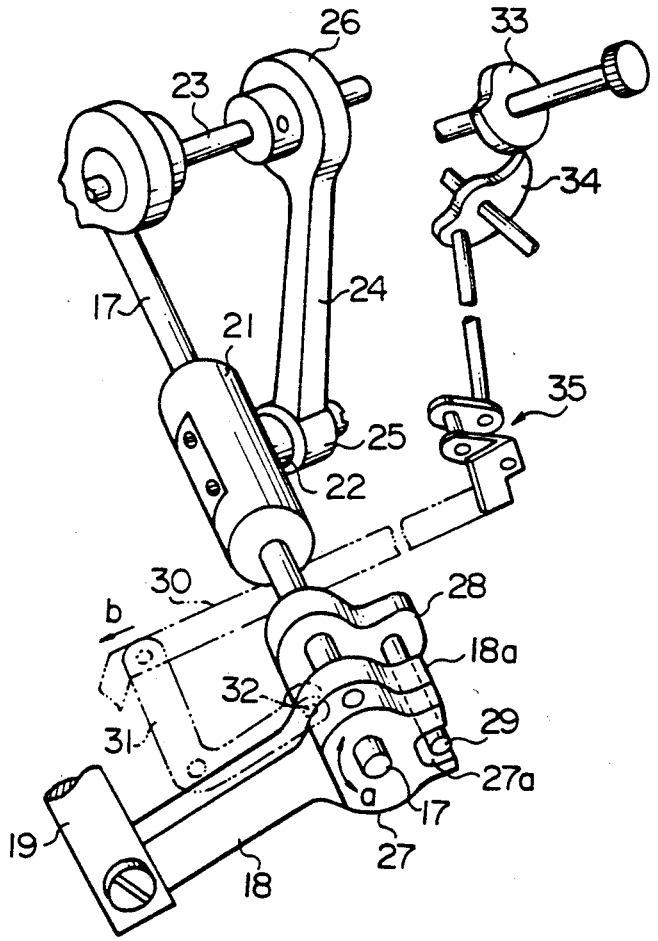
FIG. 10 is a perspective view showing a change-over means incorporated in the sewing machine.

Attention is now directed to FIG. 10 wherein a change-over means for controlling the upper looper is shown, which is disclosed in the copending U.S. patent application Ser. No. 07/866,404 filed Apr. 10, 1992 concurrently herewith (now U.S. Pat. No. 5,255,622) and entitled "Overlock Sewing Machine" that is assigned to the common assignee hereof and incorporated herein by reference.

An upper looper swing device comprises an upper looper support element, an upper looper drive element for driving the upper looper element, and a link assembly, which will be described hereinbelow. The upper looper swing device includes an upper looper shaft 17 rotatably supported on the sewing machine frame, an upper looper swing arm 18 one end of which is rotatably attached to the upper looper shaft 17, and an upper looper support arm 19 the lower end of which is pivoted to a free end of the upper looper swing arm 18. The upper looper 7 is fixed to the upper end of the upper looper support arm 19 which is guided by an upper looper slide bearing 20. Consequently, swing movement of the upper looper swing arm 18 in the direction of arrow a allows the lower looper 7 to effect its swing movement to a predetermined extent.

The upper looper drive mechanism or element provides an upper looper drive arm 21 secured to the upper looper shaft 17, an upper looper connecting arm 22 one end of which is fixed to the upper looper drive arm 21, and an upper looper swing rod 24 for connecting the upper looper connecting arm 22 to a main shaft 23. A ball-shaped member (not shown) is formed on one end, i.e., a projecting end of the upper looper connecting arm 22 and is so fitted in a bearing 25 formed on the lower end of the upper looper swing rod 24 as to afford a spheric motion. An eccentric cam (not shown) is rigidly mounted on the main shaft 23 and is rotatably fitted in a bearing 26 provided on the upper end of the upper looper swing rod 24. Subsequently, rotation of the main shaft 23 reciprocally rotates the upper looper drive arm 21, i.e., the upper loop shaft 17 about its axis in a predetermined angular range by means of the upper looper swing rod 24 and the upper looper connecting arm 22.

The link assembly serves to control swing movement of the lower looper shaft, viz., to impart or not impart such movement to the upper looper swing arm 18. The link assembly is composed of an upper looper interlocking arm 27 secured to the upper looper shaft 17, and a release element adapted for engaging or disengaging the upper looper arm 18 with the interlocking arm 27 of therefrom. The release element includes an upper looper release member 28, and an upper looper release pin 29 rigidly mounted on the release member 28. The upper looper release member 28 is slidable mounted on the upper looper shaft 17 longitudinally thereof. The upper looper release pin 29 is adapted to smoothly fit in notches 18*a* and 27*a* formed in the upper looper swing arm 18 and the interlocking arm 27. The upper looper release member 28 is moved by a motion shifter as described later, between a swing position where the release pin 29 engages with the interlocking arm 27 and a non-swing position where the pin 29 is out of engagement therewith. More specifically, in the swing position, the upper looper release pin 29 engages with the interlocking arm 27 and the upper looper swing arm 18 so that swing movement of the upper looper shaft 17 is imparted by the interlocking arm 27 to the swing arm 18, thereby swinging the upper looper 7. In the non-swing position, the release pin 29 is out of engagement with the interlocking arm 27 so that swing movement of the upper looper shaft 17 is not imparted to the swing arm 18. It is noted that in this instance the upper looper 7 assumes the lowermost position in the non-swing position.

As shown, a main shift arm 30 and an upper looper release shift arm 31 are formed into a release control means. The release shift arm 31 serves to connect the main shift arm 30 to the release member 28. The upper looper release shift arm 31 is adapted not only to rotatably support its central portion on a frame mounting plate (not shown) but also to pivot its one end to the main shift arm 30. An engageable pin 32 is fixed to the other end of the shift arm 31 and has its one end fitted in a groove (not shown) formed in the release member 28.

The motion shifter is formed by the change-over knob 1 disposed rearwardly of the sewing machine frame, a stitch conversion cam 33 secured to the shaft of the change-over dial or knob 1, and a stitch conversion lever 34 one end of which is in contact with the cam 33. In this configuration, rotation of the change-over knob 1 allows the main shift arm 30 to move longitudinally thereof through the conversion cam 33, the conversion lever 34, and a link means 35.

The main shift arm 30 is moved in the direction of an arrow b in such a manner that the shift arm 31 is rotated through the pin 32 to keep the release member 28 away from the swing arm 18. This will remove the release pin 29 out of a recess 27*a* in the interlocking arm 27 so that movement of the upper looper shaft 17 is not imparted to the swing arm 18.

Figure 4:
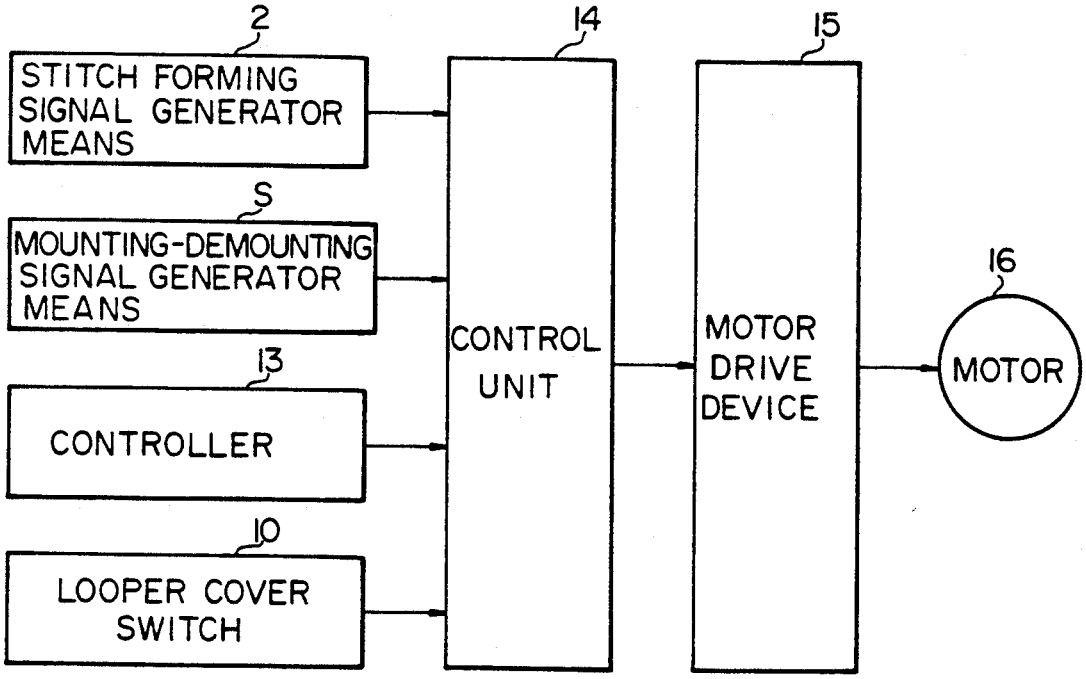
FIG. 4 is a block diagram illustrating an overall arrangement of the safety device according to the invention.

FIG. 4 is block diagram illustrating an overall arrangement of the safety device. It should be understood that the control unit 14 is connected to the stitch forming signal transmitter or generator means 2, the mounting and demounting signal generator means S, the controller 13, and the looper cover switch 10. The control unit 14 is adapted to drive and stop a motor 16 via a motor drive device 15 which is response to the signal generated from the control unit.

Figure 5:
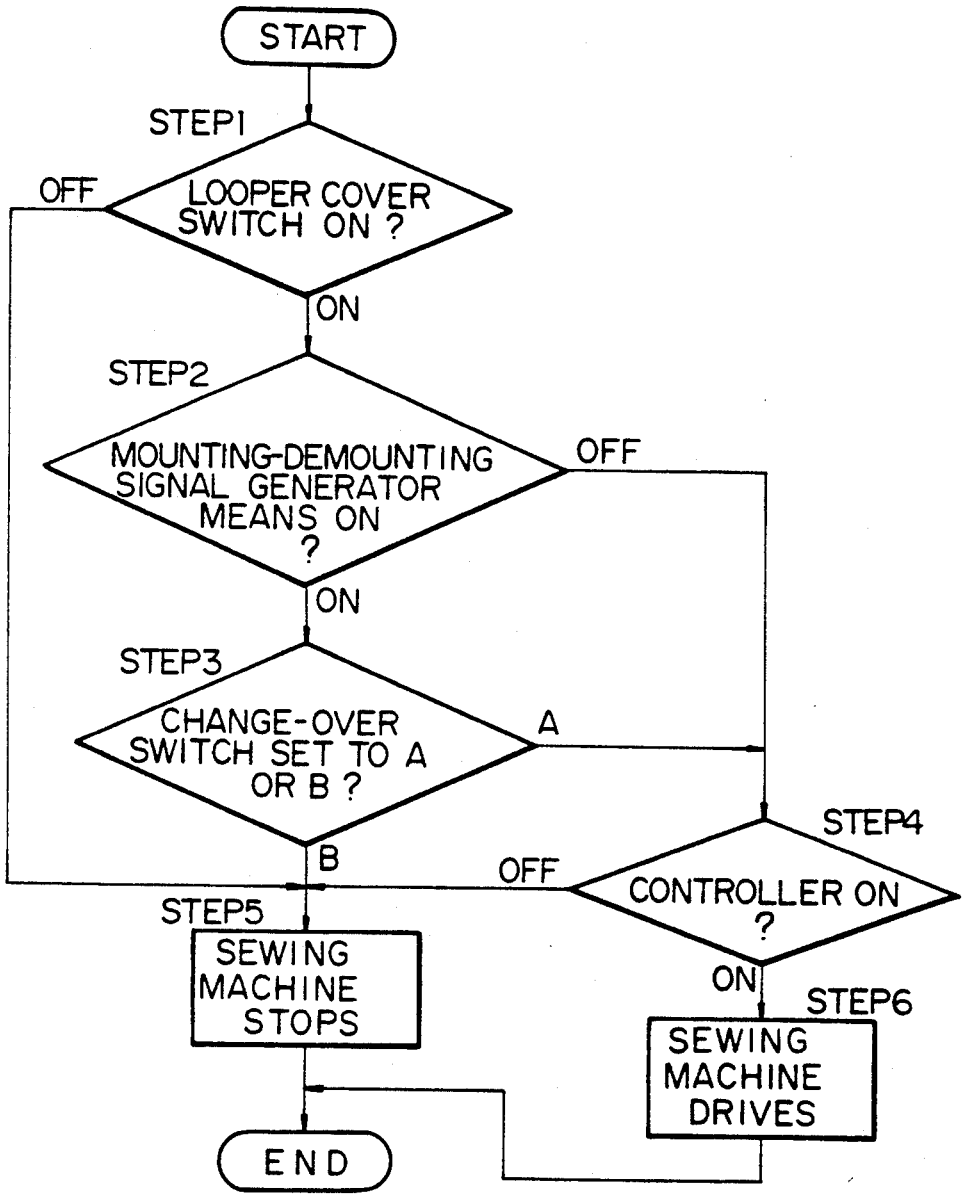
FIG. 5 is a flow chart illustrating a sequence of operations of the safety device according to the invention.
Figure 6:
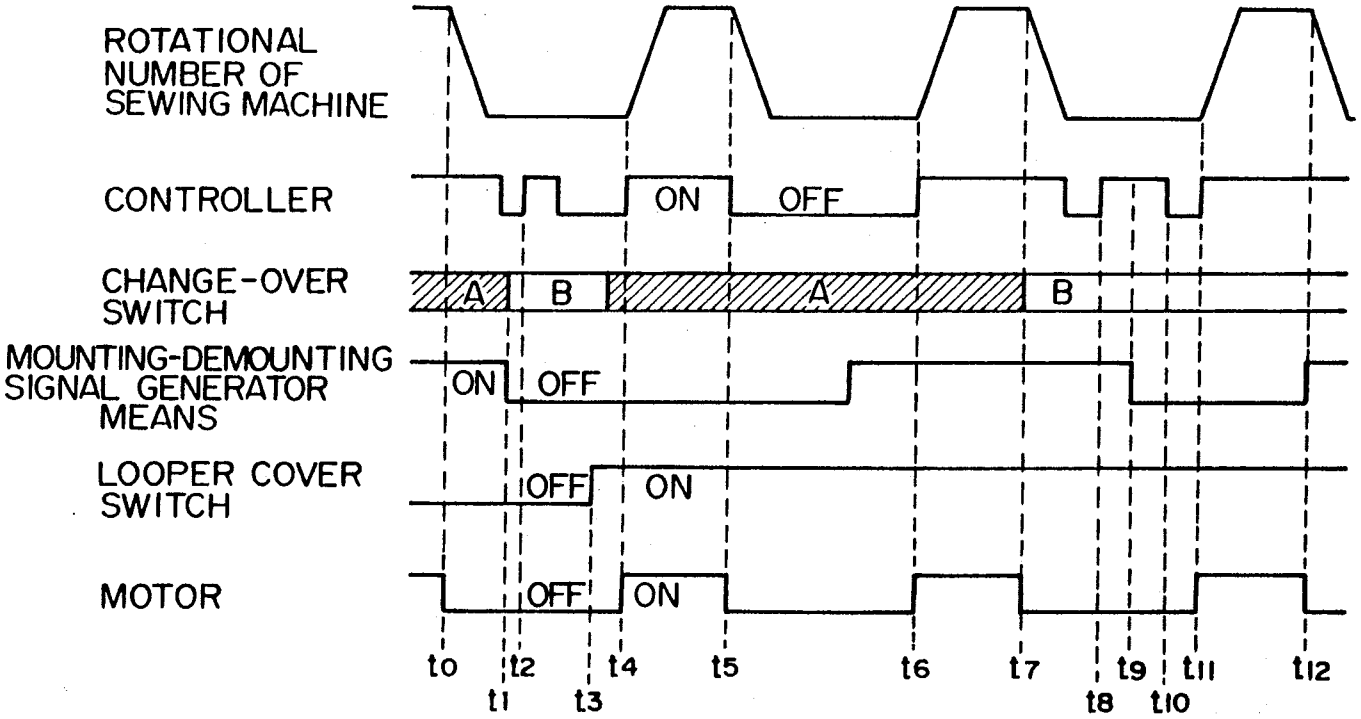
FIG. 6 is a timing chart showing a sequence of the safety device according to the invention.
Figure 7:
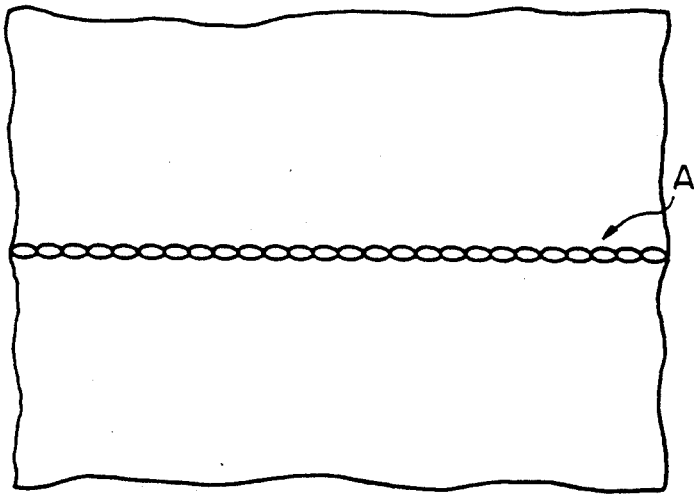
FIG. 7 is a front view of a workpiece as seamed by "one needle two thread stitches"
Figure 8:
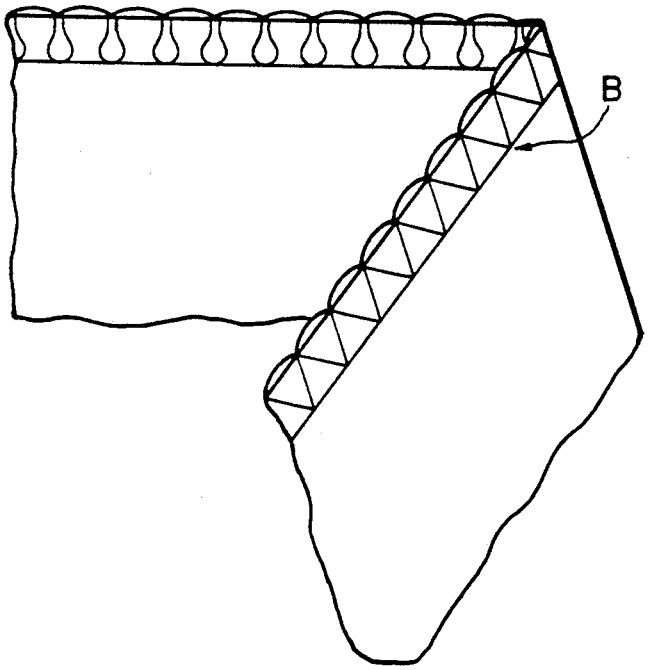
FIG. 8 is a front view of the workpiece as seamed by "one needle three thread stitches"

The operation of the safety device will be apparent from the following description by reference to FIGS. 5 and 6, which depict a flow chart and a timing chart, respectively. Referring to FIG. 5, once the sewing machine M is energized the status of the looper cover switch 10 is determined (Step 1). If the looper cover switch 10 is OFF, the sewing machine M is prevented from driving the motor (Step 5). This is illustrated at instant t0–t3 of FIG. 6. During this period of time, the sewing machine M is not driven even if the controller 13 which serves to initiate the machine M and adjust the speed thereof is operated (t2 of FIG. 6).

If, however, the looper cover switch 10 is ON the mounting-demounting signal generator means S determines whether the second work table 3 is installed (Step 2). If a demounting signal (i.e., OFF) is indicated by the signal generator means S the controller 13, which controls the sewing speed, determines motor operation (Step 4). If the controller 13 is ON the sewing machine M motor is driven (Step 6), as at instants t4, t11 of FIG. 6. In contrast, if the controller 13 is OFF the sewing machine M motor is not driven (Step 5).

If the looper cover switch 10 is ON and the mounting-demounting signal generator means S outputs a mounting signal (i.e. ON) indicating that the second work table is mounted, then step 2 is followed by step 3 where the stitch forming signal transmitter generator means 2 determines which stitch is formed by means of the change-over dial 1.

In the case where the change-over dial 1 is set to the "one needle three thread stitch B", the sewing machine M stops (Step 5), as at instant t7 of FIG. 6. At this moment, the sewing machine M is not driven even if the controller 13 is turned to ON, as at instant t8 of FIG. 6. On the other hand, in the case where the change-over dial 1 is set to the "one needle two thread stitch A" (Step 3), sewing machine M motor operation is not inhibited and controller 13 effectively controls motor operation (Step 4). If the controller 13 is turned to ON, the sewing machine M motor is driven (Step 6), as at instants t4 and t6 of FIG. 6. In contrast, if the controller 13 is turned to OFF the sewing machine M motor stops (Step 5), as at instant t5 of FIG. 6.

Although the above description provides many specificities, these enabling details should not be construed as limiting the scope of the invention, and it will be readily understood by those persons skilled in the art that the present invention is susceptible to many modifications, adaptations, and equivalent implementations without departing from this scope. For example, the specific signal generating mechanisms can be based on many different types of electronic, mechanical, and optoelectronic devices. Also, the controller unit design may be, for example, based on hardwiring of passive components, different hardware implementations, or even software. Further, the integration of the described signalling and control means into various sewing machines is susceptible to myriad adaptations.

These and other changes can be made without departing from the spirit and the scope of the invention and without diminishing its attendant advantages. It is therefore intended that the present invention is not limited to the disclosed embodiments but should be defined in accordance with the claims which follow.

I claim:

1. In a sewing machine having multiple stitch modes, a safety device comprising:

first looper means for manipulating thread;

second looper means for manipulating thread in conjunction with said first looper means;

control means for operating drive and shutdown of said sewing machine;

first signal generating means for generating either a first signal in relation to a first stitch mode or a second signal in relation to a second stitch mode, said first signal generating means comprising change-over means for selecting modes of operation of said sewing machine, wherein said first signal generating means transmits said first signal or said second signal in relation to said selected mode of operation;

mountable table means, said mountable table means being removable during said first stitch mode;

second signal generating means for generating a mounting or a demounting signal to said control means, said signal means being responsive to the presence or absence of said mountable table means; and circuit means for rendering said sewing machine inactive upon transmission of said mounting signal in conjunction with said first signal from said first signal means, said circuit means rendering said sewing machine inactive irrespective of operation of said control means when said mounting signal and said first signal are transmitted.

2. In a sewing machine having multiple stitch modes, a safety device comprising:

first looper means for manipulating thread;

second looper means for manipulating thread in conjunction with said first looper means;

control means for operating drive and shutdown of said sewing machine;

first signal generating means for generating either a first signal in relation to a first stitch mode or a second signal in relation to a second stitch mode;

mountable table means, said mountable table means being removable during said first stitch mode;

second signal generating means for generating a mounting or a demounting signal to said control means, said signal means being responsive to the presence or absence of said mountable table means;

circuit means for rendering said sewing machine inactive upon transmission of said mounting signal in conjunction with said first signal from said first signal means, said circuit means rendering said sewing machine inactive irrespective of operation of said control means when said mounting signal and said first signal are transmitted; and looper cover means for inhibiting or facilitating access to said first and said second looper means, said looper cover means comprising switch means for rendering said sewing machine inactive upon movement of said looper cover means.

3. The safety device of claim 2 wherein said looper cover means further comprises supporter means for supporting said mountable table means.

4. In a sewing machine having multiple stitch modes, a safety device comprising:

a first looper for manipulating thread;

a second looper for manipulating thread in conjunction with said first looper;

a mountable table, said mountable table being removable when a first stitch is formed;

a controller for controlling drive and shutdown of said sewing machine;

a stitch-forming signal generator;

a mounting-signal generator;

a sewing machine deactivation circuit; and a looper cover, said looper cover comprising a switch which renders said sewing machine inactive upon movement of the looper cover, wherein upon generation of a first signal by said stitch-forming signal generator in response to a first stitch mode, and a mounting signal generated by said mounting-signal generator in response to the mounting of said mountable table, said sewing machine deactivation circuit renders the sewing machine inactive irrespective of operation of said controller.

5. The safety device of claim 4 wherein said looper cover further comprises a holder, said holder having a spring for holding a chip guard cover or a mountable table.

6. A method for preventing hazardous operation of a variable-stitch sewing machine, comprising the steps of:

generating a first signal responsive to a first sewing stitch;

generating a second responsive to the mounting or demounting of an element of said sewing machine;

rendering said sewing machine inactive upon detection of said first signal generated for said first sewing stitch, and said second signal generated for the mounting of an element of said sewing machine;

detecting movement of at least one cover on said sewing machine; and rendering said sewing machine inactive in response to said detection of movement.

* * * * *